US012042102B1

(12) United States Patent
Shulman

(10) Patent No.: US 12,042,102 B1
(45) Date of Patent: Jul. 23, 2024

(54) VERSATILE COMMODE CHAIR APPARATUS ENABLING UPRIGHT-TO-LATERAL TRANSITION FOR SANITARY CARE

(71) Applicant: Burt H Shulman, Ormond Beach, FL (US)

(72) Inventor: Burt H Shulman, Ormond Beach, FL (US)

( * ) Notice: Subject to any disclaimer, the term of this patent is extended or adjusted under 35 U.S.C. 154(b) by 0 days.

(21) Appl. No.: 18/642,168

(22) Filed: Apr. 22, 2024

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/480
See application file for complete search history.

(56) References Cited

U.S. PATENT DOCUMENTS 3,050,741 A * 8/1962 Coleman ..... A61G 7/1057 5/604
5,384,920 A * 1/1995 Havens ..... A61G 7/02 5/604
6,128,788 A * 10/2000 Yamazaki ..... A61G 7/0005 4/561.1
11,857,475 B1 * 1/2024 Carrano ..... A61G 7/02

* cited by examiner

*Primary Examiner* — Huyen D Le

(57) ABSTRACT

This invention presents a commode chair apparatus designed for individuals needing assistance with toileting and sanitation. It enables a seamless transition from an upright to a lateral position, reducing the physical strain and time required for patient care. The apparatus consists of a base, a pivotably attached chair for side rotation, a bed component for side support, and interchangeable armrest and table components. A key feature is the interchangeable seat system, allowing for a standard sitting seat to be swapped with a toileting seat, facilitating easy access for sanitation and therapy. This innovative design not only makes the toileting process more efficient but also enhances comfort and safety for the user, offering solutions for air circulation and pressure relief. It represents a significant advancement in healthcare assistive technologies, providing improved convenience and quality of care, for those with mobility challenges.

13 Claims, 5 Drawing Sheets

VERSATILE COMMODE CHAIR APPARATUS ENABLING UPRIGHT-TO-LATERAL TRANSITION FOR SANITARY CARE

FIELD OF INVENTION

This invention relates to assistive technologies for healthcare, in particular, a commode chair.

BACKGROUND

The following discussion is not to be deemed admitted prior art, but merely related art to show possible background and information related to a versatile commode chair apparatus enabling upright-to-lateral transition for sanitary care procedures.

To illustrate examples of potential embodiments without limiting their scope, the following description will discuss the use of the versatile commode chair apparatus enabling upright-to-lateral transition for sanitary care. Chairs and commodes are used as examples, but it should be understood that the invention can be applied to other sitting devices and different types of sanitary removal objects.

Assistive technologies to toilet a disabled person have been proposed throughout history. These technologies point to the fact that providing care for a disabled person, during toileting, is an arduous task.

Various devices have been proposed to facilitate toileting. Typically, a disabled person requires toileting, while he is sitting on a standard chair, performing his daily activities. The caregiver needs to lift the patient and transfer him to a wheelchair, so that he can be brought to the bathroom, at this point the caregiver needs to lift the patient and place him on the standard toilet.

When the toileting activity is finished, the caregiver must lift the patient and place him in the wheelchair, such that he can be brought to the bedroom, where he is lifted and placed in bed, in a lateral lying position where sanitary cleanup activities can be performed.

After cleanup, the patient has to be lifted again and placed in the wheelchair, wheeled back to his original seat, lifted again and placed into his original seat.

This may entail as many as ten lifting procedures that need to be performed by the caregiver, making this an arduous and time-consuming task.

Additionally, the patient is made uncomfortable during each lift and may have to actively participate in the lifting processes.

Prior solutions have failed to solve the problem of simultaneously simplifying the lifting procedures for the caregiver, allowing toileting activities, and providing access for clean up.

For example, U.S. Pat. No. 6,904,622 describes an improvement to an existing bathroom toilet, to aid in stabilizing, raising and lowering a patient from the toilet. This category of assistive technology does not provide a solution to the multiple lifts required during toileting, the need for open access to his excretory areas for the caregiver's sanitary clean-up actions or the excessive time required, between the patient's request for toileting and his act of excretion.

U.S. Ser. No. 11/596,279 describes a portable commode with improved features, but this category of assistive technology does not provide a solution to the problems, stated above.

U.S. Pat. No. 6,289,534 describes a lift device, utilizing a sling, which needs to be temporarily fitted to a patient, for lifting and transporting the patient through the toileting activities, but this category provides no solution to the excessive time problem and increases this time interval.

Each of these solutions fails to meet the needed solution because they are difficult to use, cumbersome, and time-consuming.

Therefore, a need exists for a novel a versatile commode chair apparatus enabling upright-to-lateral transition for sanitary care.

BRIEF SUMMARY OF THE INVENTION

This invention relates to a versatile commode chair apparatus enabling upright-to-lateral transition for sanitary care without the need for moving a patient from to toilet and back, thus limiting the lifting procedures.

Numerous aspects of a unique versatile commode chair apparatus enabling upright-to-lateral transition for sanitary care are disclosed.

It is desirable to have a versatile commode chair apparatus enabling upright-to-lateral transition for sanitary care procedures to minimize lifting procedures. Additionally, it allows for easy transition from daily activities to toileting. Still, further, it is desirable to have a versatile commode chair apparatus enabling upright-to-lateral transition for sanitary care that is comfortable and safe for the patient.

This invention addresses the limitations and shortcomings of existing solutions by providing a commode chair apparatus, that is comfortable and safe to sit upon for an extended time, thus increasing the likelihood that the patient will be sitting in this commode chair apparatus, while performing his daily activities, when the time comes for him to be toileted.

The caregiver needs only to perform a rotation of the chair, removal of the sitting 65 seat, replacement by the toileting seat and rotation of the patient back to the upright position. The patient can begin his toileting activities, within seconds, after the need arises.

The particular embodiments disclosed, provide a means for reducing the effort, of rotating the patient, between the two positions, thus minimizing the effort put forth by the caregiver.

Additionally, while in the lateral lying position, after excretory activity, the disclosed apparatus provides an unobstructed and stable configuration of the patient, for access to his excretory areas, for enhanced sanitary cleanup.

Additionally, the ability to rotate the patient easily, allows for frequent unloading of the buttock area and access to the excretory area, allowing ambient airflow to contact the excretory area, as indicated in the treatment of some diseases of the excretory area, as well as, ameliorating pressure wounds and for application of treatment of diseases of the excretory area, such as hemorrhoids, infections, and inflammation.

The rotation of a patient may be, but not limited to, from 0° to 120° with the ideal embodiment allowing rotating approximately 90°.

It should be noted, that in a combination of vertical and lateral lying positions, the patient's clothing can be manipulated, such that the excretory area is easily exposed, by the caregiver, for excretory activities. In another embodiment, the addition of a table, to the chair, transforms the chair into a meal table and a workstation.

The disclosed device advantageously fills these needs and addresses the aforementioned deficiencies by providing a versatile commode chair apparatus enabling upright-to-lateral transition for sanitary care, improving patient quality of life, health and safety, reducing lifting procedures, and increasing safety for the caregiver.

BRIEF DESCRIPTION OF THE DRAWINGS

A versatile commode chair apparatus enabling upright-to-lateral transition for sanitary care is illustrated by way of example, and not by way of limitation, in the figures of the accompanying drawings.

While aspects of a versatile commode chair apparatus enabling upright-to-lateral transition for sanitary care will be described with reference to the details of the embodiments of the invention shown in the drawings (and some embodiments not shown in the drawings), these details are not intended to limit the scope of the invention.

DETAILED DESCRIPTION

Figure 1:
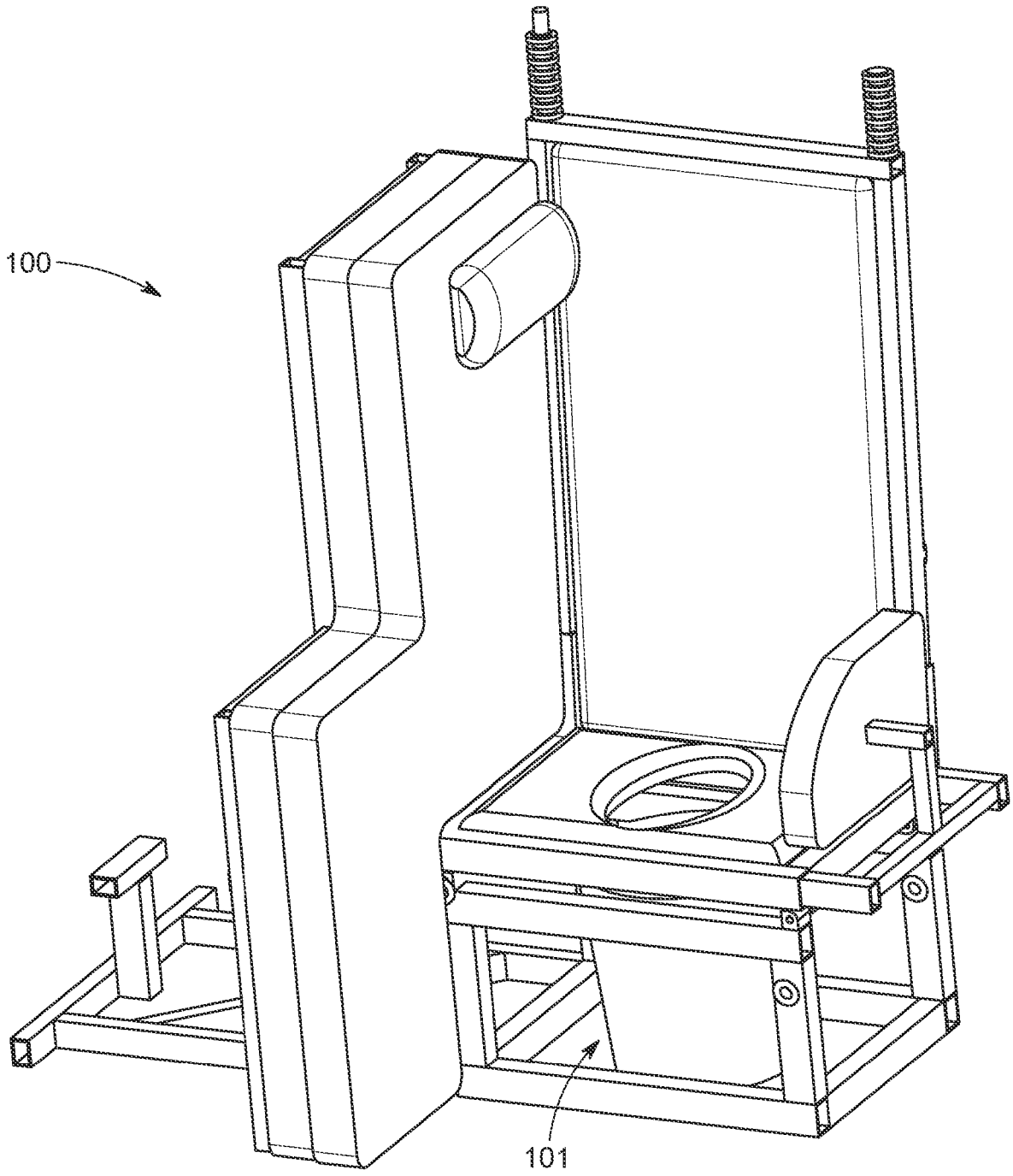
FIG. 1. A perspective front view of the fully constructed commode chair, in its upright configuration of a versatile commode chair apparatus enabling upright-to-lateral transition for sanitary care.

The order of the steps in the disclosed processes may be altered within the scope of the invention.

In conjunction with the accompanying drawings, the following detailed description provides a more specific and detailed explanation of various embodiments of the versatile commode chair apparatus enabling upright-to-lateral transition for sanitary care. These embodiments are provided to illustrate the invention but should not be seen as limiting its scope; the invention can be embodied in many different forms and is intended to be thorough and comprehensive to those skilled in the art.

Herein, not meant to be limiting, a patient is a human being who may also be referred to as an occupant, individual, patient, user, he, she, him, or her.

For the purposes of promoting an understanding of the principles of a versatile commode chair apparatus enabling upright-to-lateral transition for sanitary care, reference will now be made to the embodiments illustrated in the drawings and specific language will be used to describe the same, only as examples and not intended to be limiting.

A chair seat may come in varying sizes and shapes, including but not limited to round, square, rectangle, oval, hexagon, octagon, and irregular shapes.

A chair component covering may be made of various materials, including, but not limited to vinyl sheet, nylon powder coating, plastisols, and other materials, such as plastic coated (or uncoated) woven or non-woven materials.

Disclosed is a versatile commode chair apparatus enabling upright-to-lateral transition for sanitary care, comprising the following components: (1) a base component 1; (2) a plurality of base height adjustment components 2*a*, 2*b*; (3) a chair seat frame 3; (4) a backrest 4; (5) an armrest 5; (6) a table 6; (7) a bed 7; (8) a stabilizing component 8;

The disclosed versatile commode chair apparatus enabling upright-to-lateral transition for sanitary care is unique when compared with other known devices and solutions because it provides: (1) simple operation; (2) single caregiver operation; (3) low physical load burden for the caregiver; (4) minimal delay, for the patient, to begin toileting activities; (5) frequent unloading, air exposure and treatment access, to the patient's excretory areas, as may be required, due to the patient's medical condition.

The disclosed versatile commode chair apparatus enabling upright-to-lateral transition for sanitary care is unique in that it is structurally different from other known devices or solutions. More specifically, the device is unique due to the presence of a chair component, which is pivotalably connected to a base component, so that the chair component can be oriented in both the upright and lateral lying positions, without a consequent reorientation of the base component. This degree of freedom in combination with a supporting bed component and a removable and interchangeable seat component, facilitates toileting and sanitary care of a patient.

In some embodiments of versions of a versatile commode chair apparatus enabling upright-to-lateral transition for sanitary care, a base component 1, a plurality of base height adjustment components 2*a*, 2*b*, a chair seat frame 3, a backrest 4, an armrest 5, a table 6, a bed 7, a stabilizing component 8 may be a single component, multiple components, or a combination thereof.

In some embodiments of versions of a versatile commode chair apparatus enabling upright-to-lateral transition for sanitary care a base component may vary in size (as viewed from the front), for example, and not meant to be limiting, having a length of 50 cm to 60 cm (approximately 20 inches to 24 inches), a depth of 38 cm to 51 cm (approximately 15 inches to 20 inches) and a height of 23 cm to 35.5 cm (approximately 9 inch to 14 inches). A height adjuster component that adjusts the chair height from 30 cm to 53 cm (12 inches to 21 inches). A seat component having a length and depth commensurate with the base component and a height of 84 cm to 94 cm (33 inches to 37 inches). A bed component having a length of 5 cm to 10 cm (2 inches to 4 inches), a depth of 61 cm to 71 cm (24 inches to 28 inches) and a height of 117 cm to 127 cm (46 inches to 50 inches).

FIG. 1 shows an embodiment of a versatile commode chair apparatus enabling upright-to-lateral transition for sanitary care (100), in its upright and fully assembled state. A commode receptacle (101) is shown in its functional position.

Figure 2:
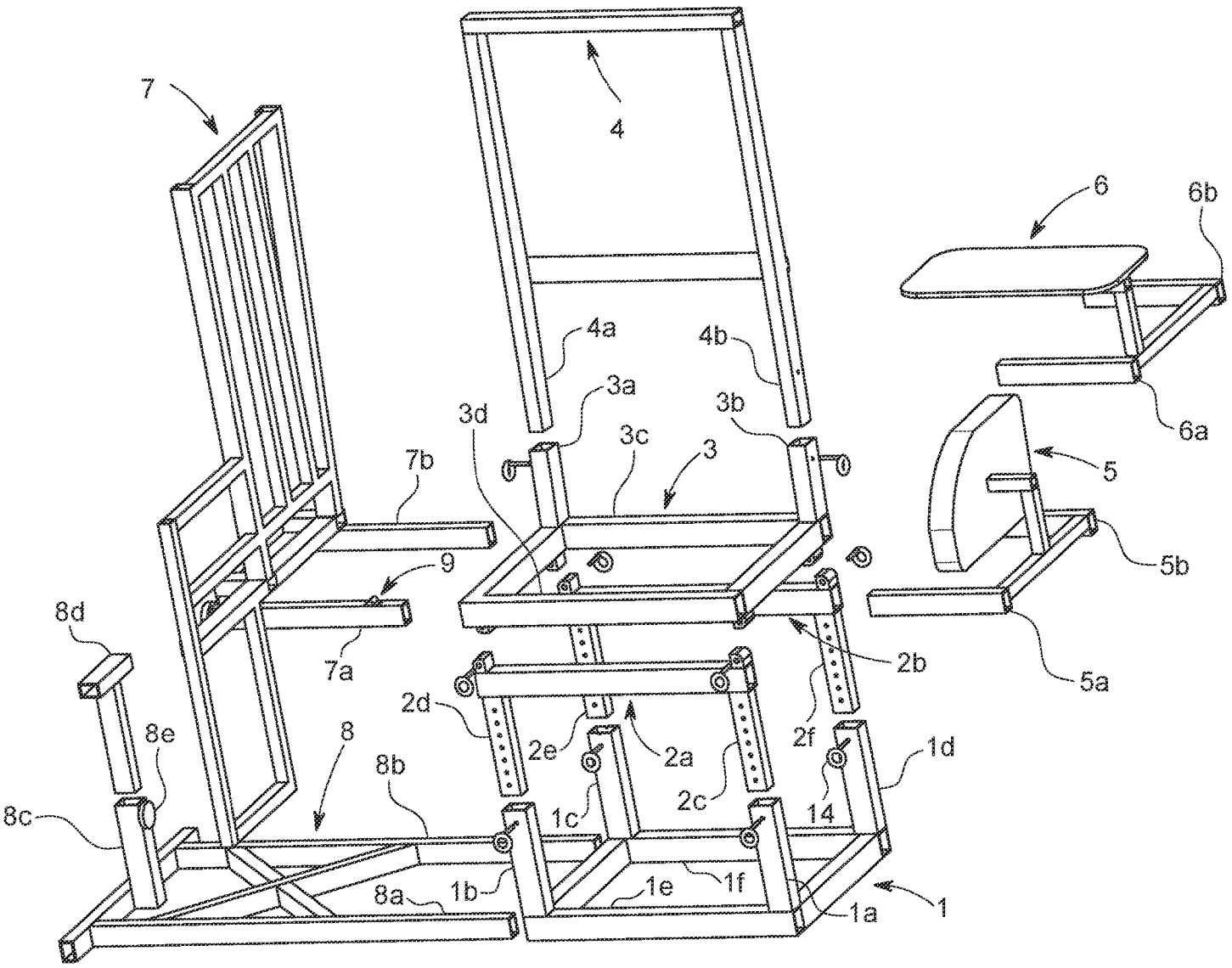
FIG. 2. A perspective, exploded view of the structural components of a versatile commode chair apparatus enabling upright-to-lateral transition for sanitary care.

FIG. 2 shows an embodiment of a versatile commode chair apparatus enabling upright-to-lateral transition for sanitary care, comprising a base component (1), base height adjustment components (2*a*,2*b*), a chair seat frame component (3), a backrest component (4), an armrest component (5), a table component (6), a bed component (7) and a stabilizing component (8).

The base component is constructed from tubing, described below, which presents four vertical receiving tubes (1*a*, 1*b* and 1*c*,1*d*). Each base height adjustment component, presents two vertical tubular mounting members (2*c*,2*d* and 2*e*, 2*f*) which telescopically engage their respective base receiving tubes.

Pull ring detent pins (14) are employed to retain the relative positions of these mating parts, and to set the overall seat height.

These components are constructed from a suitable material, such as aluminum or steel, in the form of box or cylindrical tubing of a size and wall thickness to provide sufficient rigidity, when bearing the static and dynamic loading encountered, while rotating and supporting the maximum patient weight.

The seat frame (3) is fabricated by, for instance, welding these tubes into various shapes, such as a square, rectangle, or circle.

In the present embodiment, not meant to be limiting, a rectangular shaped seat frame is depicted. The seat frame includes two receiving tubes (3*a*,3*b*), sized to accommodate the insertion of the backrest mounting members (4*a*,4*b*). The receiving tubes are fixedly attached to the seat frame, for instance, by welding.

Once inserted into the receiving tubes, the backrest mounting members are retained by pull pins (14), which facilitate backrest removal, to reduce the overall size, for shipping or replacement purposes.

The seat frame, in the present embodiment, being constructed of rectangular tubing, allows the insertion of the bed mounting members (7*a*, 7*b*) into receiving tubes (3*a*,3*b*), as well as, the armrest mounting members (5*a*,5*b*), or alternately, the table mounting members (6*a*,6*b*).

The sizing of these tubes and members creates a telescoping engagement, such that the bed, armrest and table are slideably adjustable to accommodate patients of various widths.

A stabilizing component (8) is incorporated into the base component to maintain the commode chair apparatus in a stable configuration in the vertical and lateral lying positions and the transitions between the two. Its mounting members (8*a*,8*b*) are inserted into the base receiving tubes (1*e*,1*f*) and are held in place by pull ring detent pins (14), to facilitate removal for replacement or shipping purposes.

The stabilizing component includes an upright receiving tube (8*c*). A rest height adjuster (8*d*), telescopically, inserts into the receiving tube and provides support to the bed component, when the chair is in its fully rotated lateral orientation. The adjuster's height is locked in place by a knob-driven set screw (8*e*), which, when tightened against the, inserted, telescoping portion of the adjuster, prevents its movement, under load.

Figure 5:
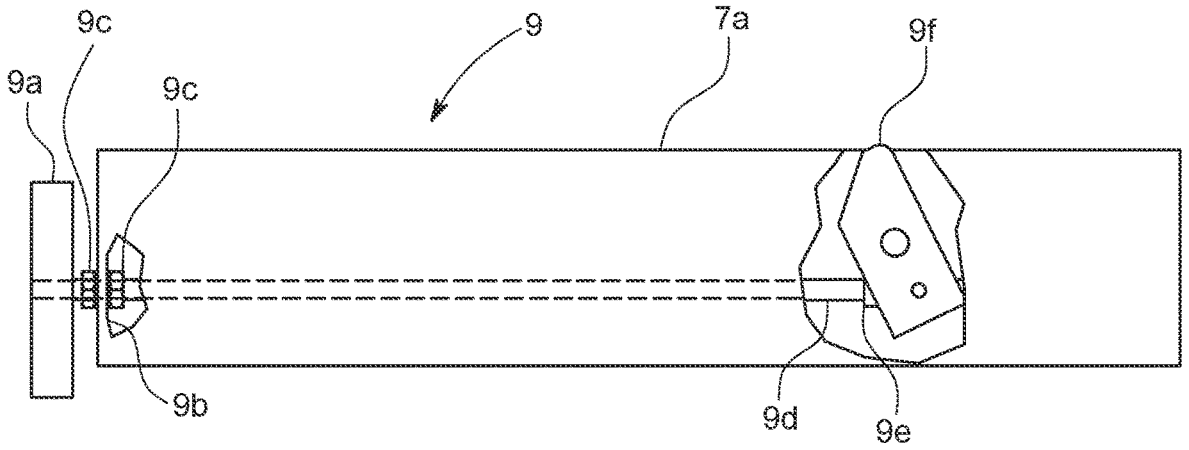
FIG. 5. An orthogonal, side, cutaway view of the bed member locking mechanism of a versatile commode chair apparatus enabling upright-to-lateral transition for sanitary care.

Partially visible in FIG. 2, is a bed locking mechanism (9), which is detailed in FIG. 5.

Figure 3:
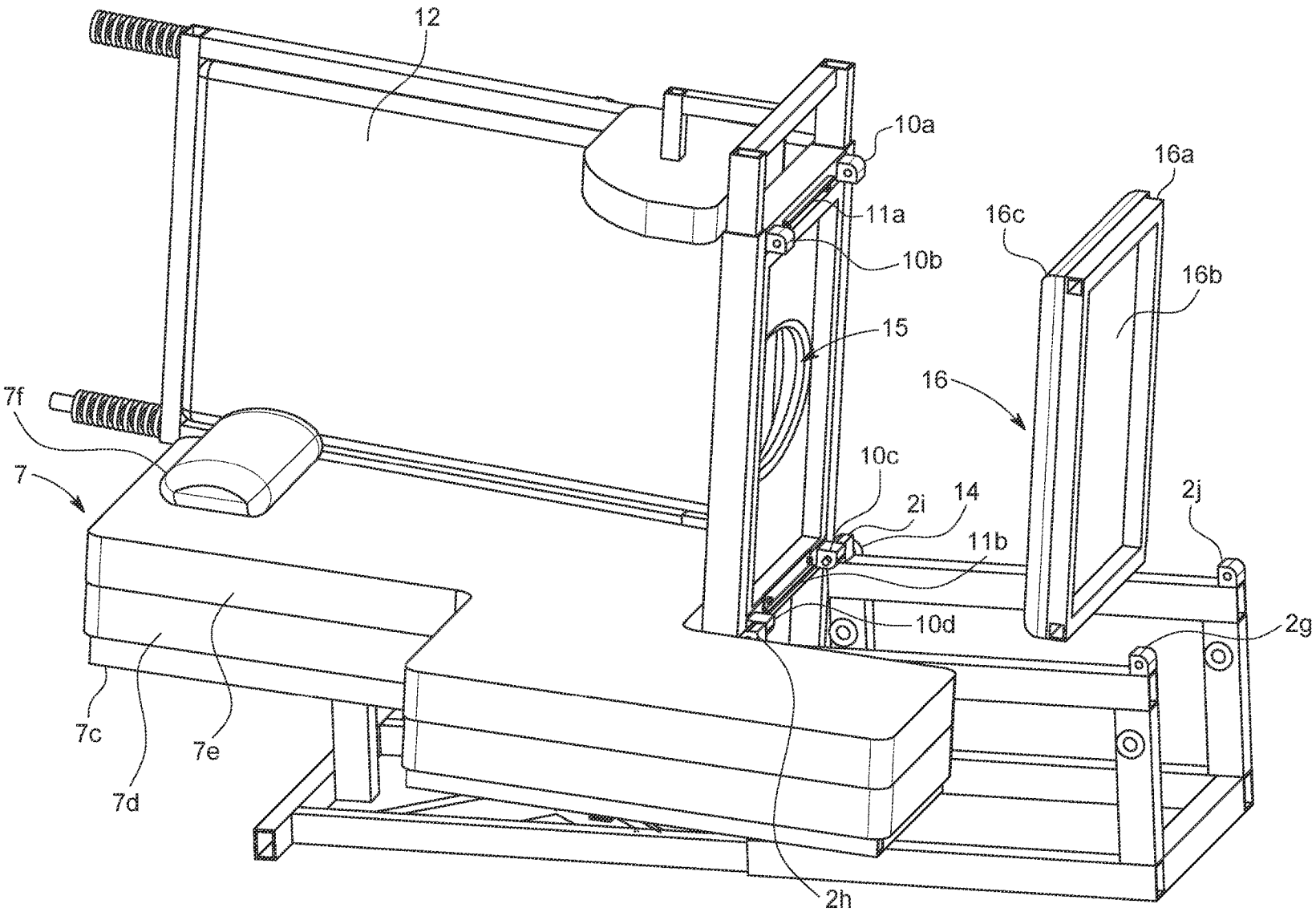
FIG. 3. A perspective, front view of the fully constructed, version of a versatile commode chair apparatus enabling upright-to-lateral transition for sanitary care, in its lateral orientation.

FIG. 3 shows a possible embodiment of the underside of the seat frame. Four pivots (10*a*, 10*b* and 10*c*,10*d*) are fixedly mounted to the seat frame. One pair of the pivots (10*c*, 10*d*) and their corresponding pivot pair (2*h*, 2*i*) is utilized, when the chair structure is configured to rotate to the left and the other pair (10*a*, 10*b*) and their corresponding pivot pair (2*g*, 2*j*) is employed, similarly, when configured for rotation to the right. The unused pivot pair, in this case (2*g*, 2*h*), provides a convenient stopping surface, when the chair component is in the upright position.

FIG. 3 exhibits a possible embodiment of a versatile commode chair apparatus enabling upright-to-lateral transition for sanitary care. Shown is a seat retainer (11*a*), slideably mounted on one side of the seat receiving opening, formed by the seat frame. A second stationary retainer (11*b*) is mounted opposite to the first. In order to insert the sitting seat or the toileting seat, the slideably mounted seat retainer is moved outward, so that its overhanging lip becomes parallel to the seat frame tubing.

During operation, the appropriate seat is placed in the seat receiving opening, so that the leading edge of the seat is retained by the stationary seat retainer. The trailing edge is, then, brought flush with the seat frame tubing and the slideably mounted seat retainer is moved, inward, so that its overhanging lip retains the seat. The seat is removed by reversing the aforementioned process.

The sitting seat (16) is comprised of a seat frame (16*a*), a cushion support plate (16*b*), and a cushion (16*c*). The cushion may be of a passive type, such as memory foam, or of an active type, such as an alternating pressure system, chosen to provide sustained patient comfort, during long durations, when sitting in this commode chair apparatus. FIG. 3, also, shows a toileting seat (15), in place, for use.

The toilet seat is constructed similarly to the sitting seat, except for the elliptical opening in its center and its cushion type, such as readily cleanable padding.

FIG. 3 shows the bed component (7) which is comprised of a bed frame (7*c*), a spacer block (7*d*) a cushion (7*e*) and a pillow (7*f*). The spacer block provides a solid surface for the cushion, to prevent the cushion from protruding through the open areas of the bed frame under the patient's weight. The spacer block, along with the bed frame's slideable adjustment feature, positions the cushion, in this embodiment, so that the cushion's resting surface can be brought into side contact, with the narrowest patient, when the bed component position is adjusted, maximally inward. This configuration allows the cushion to abut the patient's hip and shoulder to prevent substantial movement, during reorientation, thus stabilizing the patient. Additionally, the bed component constituents (7*c*, 7*d*, 7*e*) are formed in the projected shape of a seated patient, such that, along with pillow, (7*f*) provide comfortable support to the patient's head, torso, legs, and feet, during lateral lying positioning. The bed frame, spacer block and cushion are suitably bonded together with adhesive or hook and loop attachments. A head supporting pillow (7*f*) is removeably attached to the bed component, by a hook and loop or similar attachment.

Figure 4B:
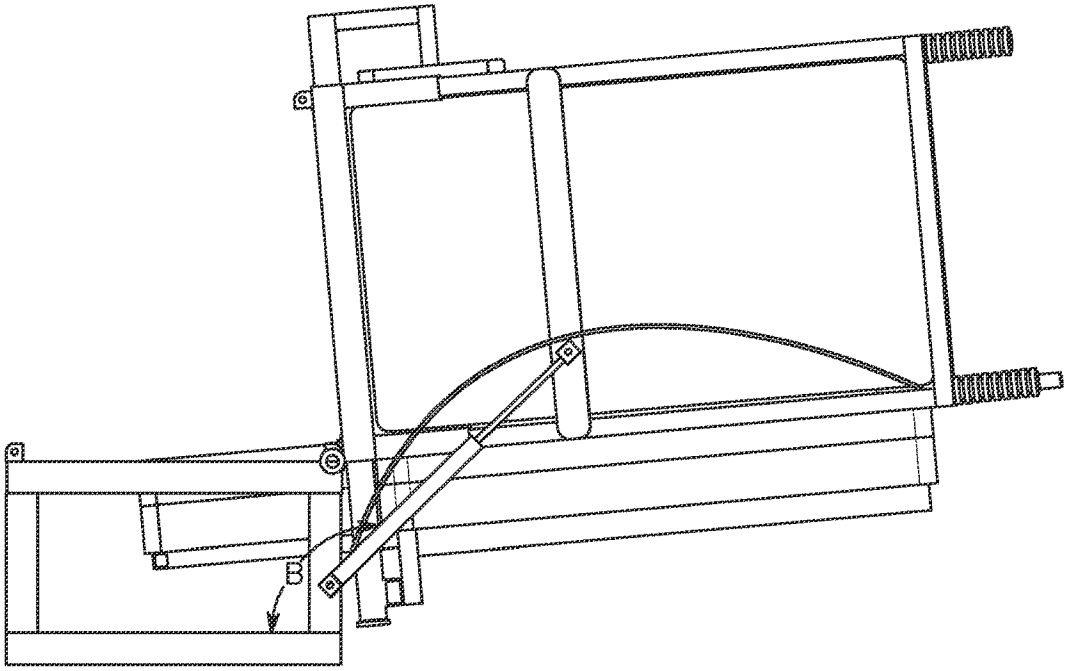
FIG. 4. An orthogonal rearview of the commode chair, showing the upright (FIG. 4A) and lateral (FIG. 4B) orientations of a versatile commode chair apparatus enabling upright-to-lateral transition for sanitary care.
Figure 4A:
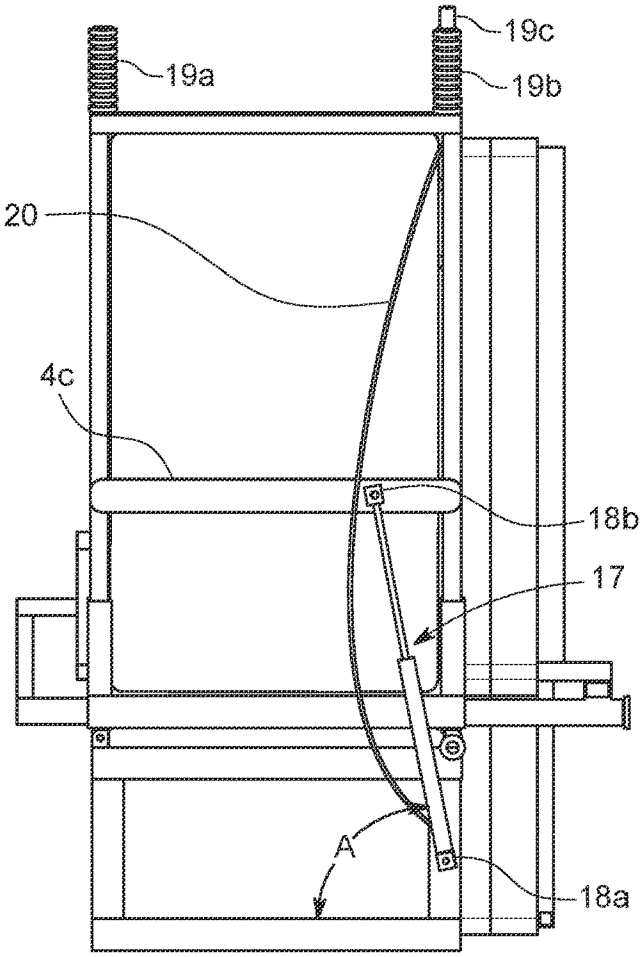

FIG. 4 shows the commode chair apparatus as viewed from the rear, where the caregiver would be positioned, while rotating the patient. A hydraulic pneumatic lift spring (17) is located in the lower right-hand corner of the commode chair apparatus, when the commode chair apparatus is configured for chair rotation to the right, as seen from the back. The lift spring provides both an assistive and resistive force, during rotation, due to it's geometry with respect to the rotation axis of the pivots. This directed force greatly lessens the effort required by the caregiver, to rotate the patient.

The lift spring is chosen from commercially available products, with known dimensions and lift force capabilities. The preferred lift spring provides about 200 lbs of extension force, along its axis.

The lower end of the lift spring is fastened to the receiving tube (1*c*) of the base component, by way of a spherical rod end connector (18*a*). The upper end is similarly fastened to the seat frame cross member (4*c*) with spherical rod end connector (18*b*) and are used to accommodate the different angulation between the rotation plane of the lift spring and chair, which occur during chair rotation. Additionally, the distance between the lift spring's mounting points changes, as the seat is rotated. The mounting points are determined, such that, the caregiver applied force, to the handle set (19 *a,b*), needed to rotate the patient, chair, bed and armrest, from vertical to lateral, are approximately equal. In this embodiment, the caregiver applied force is approximately plus or minus 40 lbs (maximum), The particular orientation angles, taken by the lift spring are noted as A and B.

The commercially available lift spring mechanism, includes an internal locking feature to prevent the chair from movement, should the patient's loading be partially or fully removed from the chair. One of the handles (19*a*) of the handle set (19*a*, 19*b*) contains a finger-operable plunger (19*c*) which, when depressed by the caregiver, operates the locking release cable (20).

FIG. 5, shows the bed component locking mechanism (9), in detail. The bed mounting member (7*a*) contains a locking cam (9*f*), which is rotated, such that it protrudes from the bed mounting member. This action jams the cam against the inner wall of the receiving tube, which locks the bed mounting member in a fixed position. The cam is rotated, as a threaded driveshaft (9*d*) screws into the threaded clevis (9*e*). The driveshaft is restrained, from moving into or out of the bed mounting tube, because it is captured by two stop nuts (9*c*) positioned on either side of end cap (9*b*). The end cap is fixed to the end of the bed mounting member. The drive shaft is rotated by the caregiver, utilizing a knob (9*a*), which is fixed to the driveshaft. The bed mounting member is unlocked, as the knob is rotated in the opposite direction. The present embodiment utilizes one locking member, for ease of operation, as this is sufficient to retain the bed position during patient reorientation.

A version of the device is a method for using a versatile commode chair apparatus enabling upright-to-lateral transition for sanitary care. The method requires the patient to be seated in the commode chair apparatus. When the patient needs to be toileted, the caregiver inserts the bed component connecting tubes into the chair receiving tubes (if the bed component is not already in place, at the time of the toileting request). The bed component is pushed inwardly, such that the cushion abuts the patient's hip area. The bed component locking knob is operated to lock the bed component's position. The caregiver, then moves behind the commode chair apparatus and grasps the two chair handles. The caregiver informs the patient, that they are going to be rotated to the lateral lying position and then depresses the lift spring unlock button, allowing the chair to be slowly rotated to the lateral lying position. The caregiver then moves to the seat side of the commode chair apparatus and operates the seat retainer component, allowing the sitting seat to be removed and then installs the toileting seat, and moves the seat retainer, to hold the toileting seat in place. The commode bucket is then unlidded and the caregiver returns to the back of the chair, to unlock the lift spring and return the patient to the upright position. When the patient has finished their toileting activities, the caregiver returns to the back of the commode chair apparatus and repeats the earlier steps, to rotate the patient to the lateral lying position, where the toileting seat is removed and sanitary clean up is performed. The the sitting seat, is then reinstalled and retained in place, and the patient is returned to the upright position. The bed component is moved outwardly from the patient or completely removed and stowed nearby.

Versions of a versatile commode chair apparatus enabling upright-to-lateral transition for sanitary care may be made individually, in batches, or via continuous assembly.

For instance, to create one possible embodiment a versatile commode chair apparatus enabling upright-to-lateral transition for sanitary care, prepare a suitable work surface and gather all the mentioned components. Assemble the components in a logical order, following the practices of a skilled person in the field. Begin by inserting the height adjusters' mounting members, into their respective base component receiving tubes. Holding each in turn, at the proper height, a pull ring detent pin is inserted, to fix the height adjusters' position. The chair component is assembled by inserting the chair backrest connecting members, into their respective chair frame receiving tubes and pull ring detent pins are inserted to fix these components together. The assembled chair component is placed on the base component, so that the four pivot pairs are aligned and two pull ring detent pins are inserted, one into each of the active pivot pairs. Moving to the back of the chair, the lift spring connector ends are aligned with the two mounting bolts, one located on the rear height adjuster and one on the structural member which extends across the back of the backrest. Nuts are then used to secure the connectors. The lift spring operating cable is then attached to the lift spring actuator. At this point, the stabilizing component is assembled by sliding the rest height adjuster into the vertical receiving tube of the stabilizing component and when at the proper height, is then locked into place by the lock knob. The stabilizing component mounting members are then slid into the base receiving tubes and are locked into each with a pull ring detent pin. The commode chair apparatus is further assembled, by rotating the chair into the lateral lying position and inserting and locking the sitting seat into the chair frame, The bed component is then added to the assembly, by sliding its mounting members into the chair frame receiving tubes and subsequently locking the bed component in an appropriate position. The armrest or table mounting members are inserted into the chair frame receiving tubes. The back cushion is placed into the backrest cushion mounting area. The commode chair apparatus is now complete and ready for use.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

The embodiments of a versatile commode chair apparatus enabling upright-to-lateral transition for sanitary care may be utilized individually, concurrently, or in any sequential combination.

Those skilled in the art to which this application relates will appreciate that other and further additions, deletions, substitutions and modifications may be made to the described embodiments.

The specification is not to be taken in a limiting sense, but is made merely for the purpose of describing the general principles of exemplary embodiments; many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

The invention is described with such embodiments, but the invention is not limited to any embodiment. The scope of the invention is limited only by the claims and the invention encompasses numerous alternatives, modifications and equivalents. Several specific details are set forth in the description to provide a thorough understanding of the invention. These details are provided for the purpose of example and the invention may be practiced according to the claims without some or all of these specific details. In general, the order of the steps of disclosed processes may be altered within the scope of the invention.

Unless otherwise indicated, the drawings are intended to be read (e.g., arrangement of parts, proportion, degree, etc.) together with the specifications, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" mean positioned or supported on not necessarily in direct contact with the surface.

What is claimed:

1. A commode chair apparatus for reorienting an occupant from an upright sitting position to a lateral lying position, comprising:

a base component;

a chair component pivotably affixed to the base component, capable of rotating approximately 90°;

a bed component slideably connected to the chair component, facilitating its positioning adjacent to the occupant;

an armrest component; and an auxiliary table component;

wherein the chair component is capable of transitioning the occupant from the upright sitting position to the lateral lying position and back, facilitating toileting and sanitary care procedures.

2. The commode chair apparatus of claim 1, wherein:

the chair component includes a comfortable sitting seat that is replaceable with a toileting seat for toileting activities when in the lateral lying position; and the toileting seat is removable to create unobstructed access for sanitary cleanup of an occupant excretory areas.

3. The commode chair apparatus of claim 1, further comprising:

a mechanism for easy transitioning of the comfortable sitting seat to the toileting seat and vice versa, to streamline a process of toileting and sanitary cleanup.

4. The commode chair apparatus of claim 1, further comprising:

the toileting seat having a supporting structure with an elliptical hole, centrally located, and padding with a similar hole atop the supporting structure; and a removable pillow attached to the bed component and positioned to support the occupant's head when in the lateral lying position.

5. The commode chair apparatus of claim 1, further comprising:

the base component of the commode chair apparatus of a given size to accommodate a standard commode bucket with a lid;

the armrest component slideably located on one side of the commode chair apparatus; and the auxiliary table component which can be slideably located in place of the armrest component.

6. The commode chair apparatus of claim 1, wherein:

the bed component provides support and comfort to the occupant in the lateral lying position to aid in a sanitary cleanup process;

the bed component stabilizes the occupant head, torso, legs and feet, to minimize sideways movement during reorientation; and wherein the bed component can be positioned to accommodate occupants of different widths.

7. The commode chair apparatus of claim 1, wherein:

the apparatus includes a stabilizing component to maintain stability in both the upright sitting position and the lateral lying position and during the transition between these positions.

8. The commode chair apparatus of claim 1, wherein:

the base component, chair component, bed component, armrest component, and table component are constructed from materials providing sufficient rigidity and comfort, capable of supporting the static and dynamic loading encountered during use.

9. The commode chair apparatus of claim 1, further comprising:

a pneumatic-hydraulic spring, with a top connector and a bottom connector, wherein the bottom connector is attached to the base component of the commode chair apparatus and the top connector is attached to the chair component, configured to provide an appropriate assisting or resisting force during rotation from the upright sitting position to the lateral lying position and vice versa, and incorporating an integral release and locking mechanism, activated by a button, located in one of two chair handles, located at a top of the chair component backrest.

10. The commode chair apparatus of claim 1, further characterized by:

the ability to facilitate air circulation around the occupant's excretory areas, and unload the occupant's buttock area, when in the lateral lying position, beneficial to aid in the treatment and prevention of medical conditions associated with the excretory areas.

11. The commode chair apparatus of claim 1, further including:

a locking mechanism for securing the bed component in place during the transition of the chair component between the upright sitting position and the lateral sitting position, and during use in either position.

12. The commode chair apparatus of claim 1, wherein:

the table component can be adjusted or removed to accommodate the occupant's needs for dining, reading, or other activities while in the chair, enhancing the versatility and utility of the apparatus.

13. A method of facilitating toileting and sanitary care for an individual using the commode chair apparatus of claim 1, comprising the steps of:

rotating the chair component from an upright sitting position to a lateral lying position;

replacing the sitting seat with a toileting seat;

returning the chair component to the upright sitting position for toileting;

rotating the chair component back to the lateral lying position after toileting;

removing the toileting seat to enable sanitary cleanup;

replacing the toileting seat with the sitting seat; and returning the chair component to the upright sitting position, thereby completing the toileting and sanitary care process.

* * * * *